US005142466A

United States Patent [19]

Foster et al.

[11] Patent Number: 5,142,466

[45] Date of Patent: Aug. 25, 1992

[54] NEON TUBE HIGH-RISE LIGHTING SYSTEM, SUPPORT, ASSEMBLY AND EXTRUSION THEREFOR

[76] Inventors: Ronald A. Foster, 1330 Deer Ridge, Duncanville, Tex. 75137; Ruben A. Reyes, 3527 Rio Grande Cir., Dallas, Tex. 75233; Donald W. Murray, 517 Meadow St., Saginaw, Tex. 76179

[21] Appl. No.: 762,772

[22] Filed: Sep. 20, 1991

[51] Int. Cl.[5] ..... F21S 3/00

[52] U.S. Cl. ..... 362/368; 362/362; 362/367; 362/224; 362/283; 362/223; 362/260; 362/275; 362/455

[58] Field of Search ..... 362/368, 362, 367, 224, 362/255, 256, 283, 306, 307, 311, 326, 331, 333, 223, 222, 217, 260, 262, 263, 374, 375, 455; 40/542, 545, 549, 558

[56] References Cited

U.S. PATENT DOCUMENTS

| | | | |
|---|---|---|---|
| 4,201,004 | 5/1980 | Witt | 40/545 |
| 4,338,653 | 7/1982 | Marren | 362/223 |
| 4,420,798 | 12/1983 | Herst et al. | 362/368 X |
| 4,947,301 | 8/1990 | Steele | 362/374 X |
| 5,001,613 | 3/1991 | Foster et al. | 362/362 X |
| 5,025,355 | 6/1991 | Harwood | 362/223 X |

FOREIGN PATENT DOCUMENTS

| | | | |
|---|---|---|---|
| 291891 | 7/1965 | Netherlands | 362/224 |

*Primary Examiner*—Larry Jones
*Attorney, Agent, or Firm*—David H. Judson

[57] ABSTRACT

An assembly for supporting a neon tubing comprises a length of extrusion and at least first and second lenses supported in the extrusion. Preferably, the extrusion includes an angled bottom member having first and second legs. First and second wall members extend transversely to the first and second legs, respectively, of the angled bottom member, with each of the first and second wall members having a medial portion and an end. The extrusion further includes a service rail extending at an obtuse angle from the end of each of the first and second wall members, and the service rail includes a tapered medial portion and a retaining flange. Each of the first and second lenses are supported in a receving channel of the extrusion and has a predetermined length less than the predetermined length of the extrusion. The second lens is movable between a first position, with the first and second lenses supported in a substantially end-to-end fashion, and a second position, with the first and second lenses supported in a substantially overlapped fashion to facilitate access to the underlying neon tubing.

10 Claims, 3 Drawing Sheets

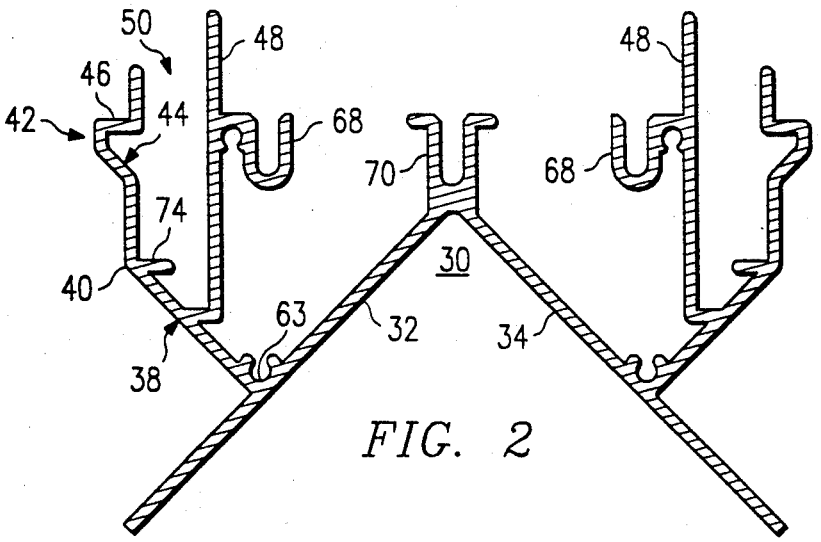
FIG. 2
FIG. 3
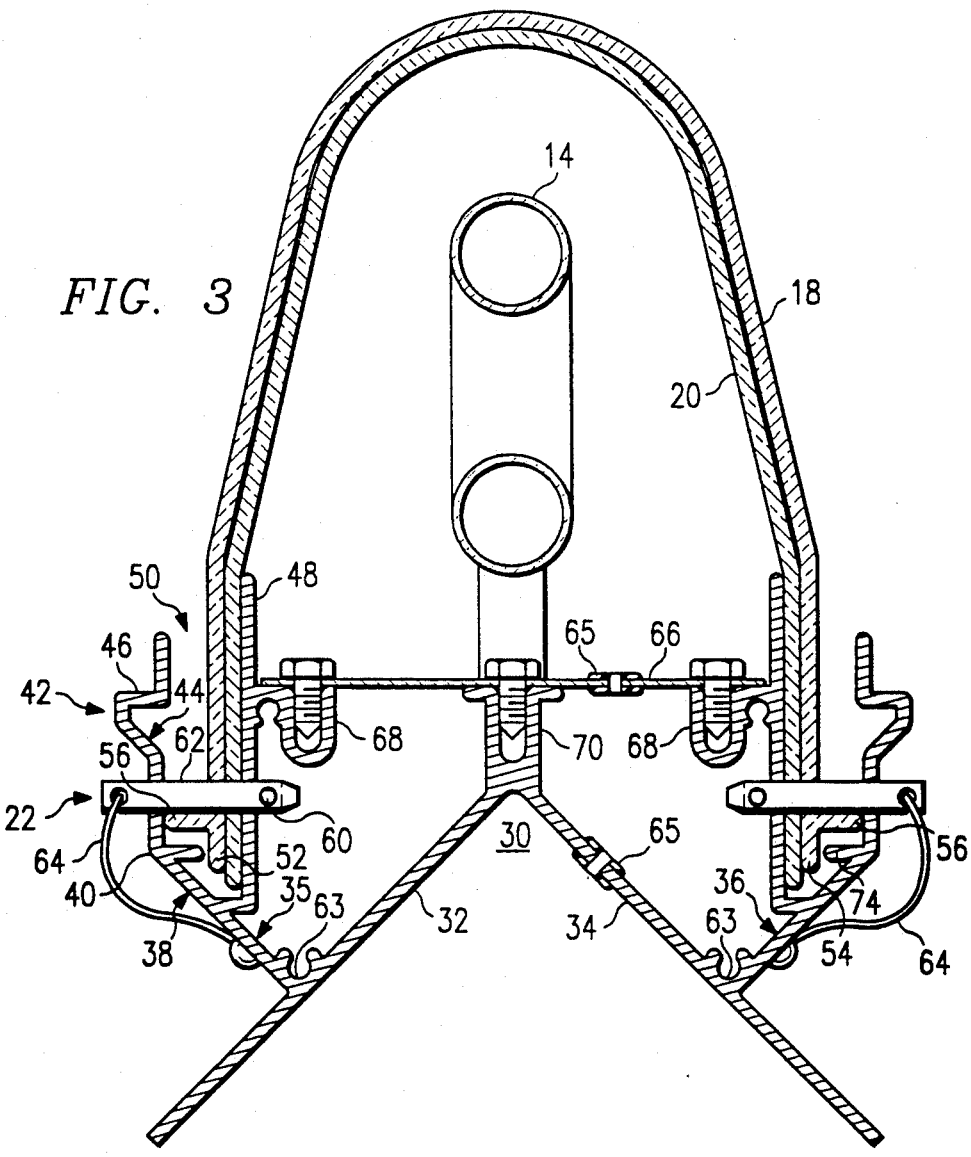

NEON TUBE HIGH-RISE LIGHTING SYSTEM, SUPPORT, ASSEMBLY AND EXTRUSION THEREFOR

TECHNICAL FIELD

The present invention relates generally to lighting systems for high-rise building structures and particularly to a support assembly and extrusion therefor for use in supporting a neon tube.

BACKGROUND OF THE INVENTION

It is well-known to use neon tubing to provide decorative lighting effects for signage and building facades. Typically, the neon tubing is supported in a free-standing manner by merely embedding or affixing a tube support in the sign or facade. The neon tubing is then secured to or otherwise supported on the tube support. Such conventional border-neon installations are, of course, subject to extreme wear and degradation due to weathering and other environmental effects. The neon tubing can also be easily damaged since it is unprotected. These limitations severely limit the reliability of neon tube lighting systems and increase the cost thereof significantly.

With prior art systems, it also has not been possible to support neon tubing along a vertical extent of a high rise building in a manner that maintains architectural integrity, provides a straightline appearance of uninterrupted light, or can withstand detrimental environmental effects.

It would therefore be highly desirable to provide improved neon tube lighting systems and support assemblies for overcoming these and other problems associated with the prior art.

BRIEF SUMMARY OF THE INVENTION

It is an object of the present invention to provide a neon-tube lighting system that protects the neon tubing from environmental and other physical damage.

It is yet another object of the invention to provide a cost-effective, safe and reliable neon tube lighting system for use in a high-rise building.

It is still another object of the invention to describe a novel support assembly for supporting neon tubing.

It is another object of this invention to provide a novel structural extrusion for use in a support assembly of a neon lighting system which overcomes the problems associated with free-standing neon lighting systems of the prior art.

These and other objects of the invention are provided in an assembly for supporting a neon tubing and comprising a length of extrusion and at least first and second lenses supported in the extrusion. Preferably, the extrusion includes an angled bottom member having first and second legs. First and second wall members extend transversely to the first and second legs, respectively, of the angled bottom member, with each of the first and second wall members having a medial portion and an end. The extrusion further advantageously includes a service rail extending at an obtuse angle from the end of each of the first and second wall members, and the service rail includes a tapered medial portion and a retaining flange. The extrusion also may include an inner support leg extending at an obtuse angle from the medial portion of each of the first and second wall members to form a receiving channel between each service rail and each inner support leg of the extrusion.

According to the invention, each of the first and second lenses are supported in the receiving channel of the extrusion. Each lens has a predetermined length less than the predetermined length of the extrusion such that the second lens is movable between a first position, with the first and second lenses supported in a substantially end-to-end fashion, and a second position, with the first and second lenses supported in a substantially overlapped fashion to facilitate access to the underlying neon tubing.

In the preferred embodiment of the invention, each of the first and second lenses of formed of a resilient compressible material and includes first and second bottom edges received in the receiving channels. At least one bottom edge of the second lens has an outwardly-extending member that slides into the tapered medial portion of the service rail and then is retained against the retaining flange thereof to enable the second lens to be moved from the first position to the second position. The outwardly-extending member is slid into the tapered medial portion of the service rail by a spring force provided by the resilient compressible material of the second lens.

According to another feature of the invention, the assembly includes a retractable fastener means for retaining each lens member in the receiving channels of the extrusion. The retractable fastener means includes a compression type pin, and spring means for moving the compression type pin between a first closed position and a second open position. A tether is provided for retaining the compression type pin when in the second open position.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which:

FIG. 2 is an elevational view of the preferred structure of the extrusion for use in the neon tube support assembly of the present invention;

FIG. 3 is a detailed cross-sectional view of the preferred neon tube support assembly showing the extrusion and first and second lenses supported in a first position;

Similar reference characters refer to similar parts throughout the several views of the drawings.

DETAILED DESCRIPTION

Figure 1:
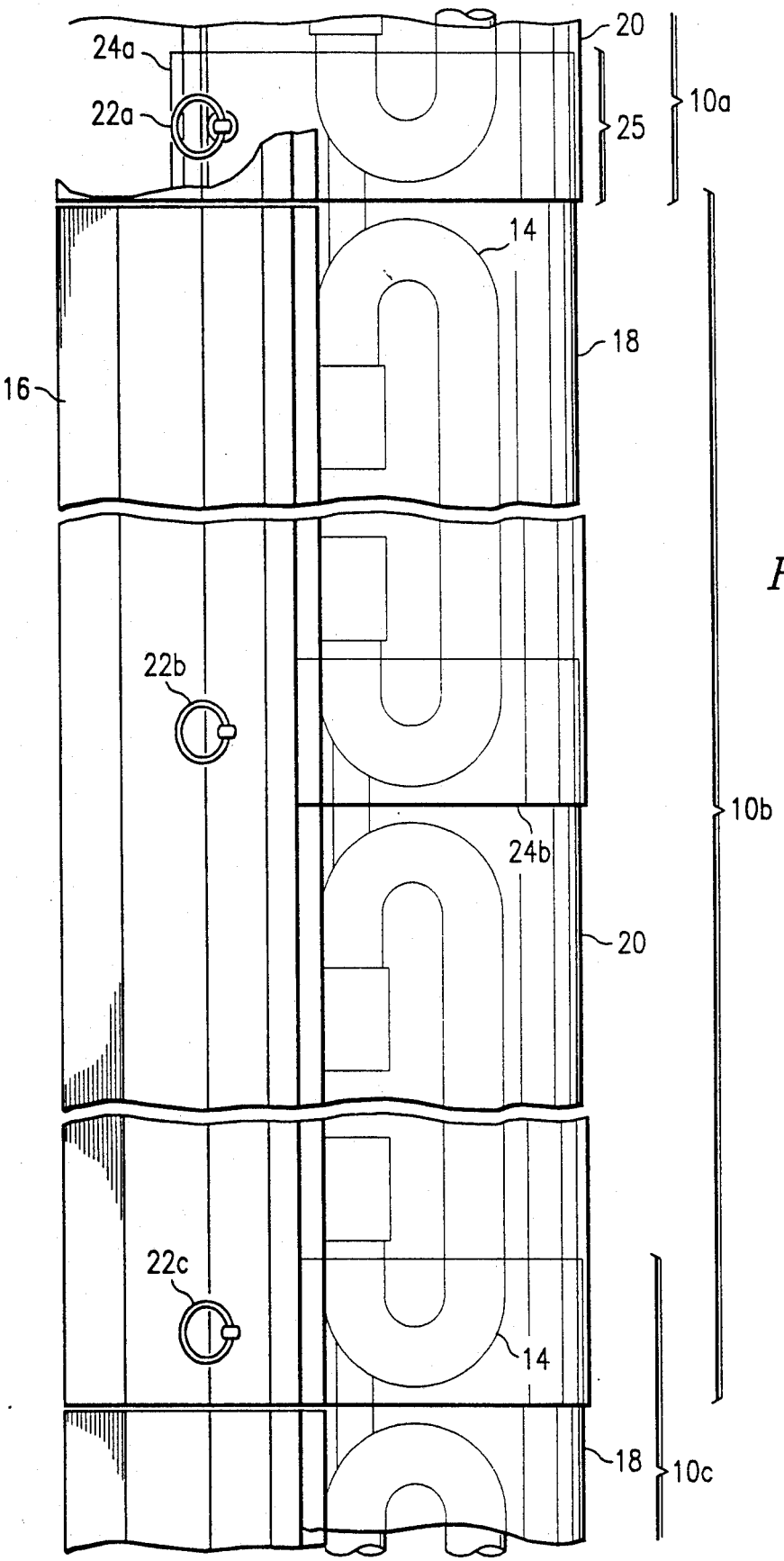
FIG. 1 is a perspective view of a portion of a high-rise building facade having a neon tube lighting system incorporating the principles of the present invention.

Referring now to FIG. 1, a perspective view is shown of a neon tube lighting system incorporating the principles of the present invention. The system is designed to be supported along a vertical extent of a high-rise building or other structural support and includes a number of continuous neon tube support subsystems 10*a*, 10*b* and 10*c* supported on the building facade. Each subsystem includes a support assembly 12 to support a pair of neon tubes 14 for providing decorative lighting. Although not meant to be limiting, each support assembly, such as assembly 10*b*, includes an extrusion 16 having a predetermined length, and at least first and second lenses 18 and 20. The length of each lens is less than the length of the extrusion for the purposes to be described.

Although the teachings of invention are described in conjunction with neon lighting systems for a building facade, the principles of this invention are applicable to any neon tubing installation as well as in connection with other types of lighting (such as fluorescent and incandescent lighting). Moreover, although the preferred embodiment concerns use of the invention for a corner-mounted high-rise building facade, the use of the invention is not intended to be so limited. It will be readily appreciated by those skilled in the art that the inventive concepts disclosed herein are useful for horizontal lighting systems as well.

Preferably, the extrusion 16 in each support assembly is extruded from 6063 alloy, T5 tempered aluminum, with a predetermined length of approximately 25 feet. The aluminum alloy is suitable for anodizing or powder coating to reduce maintenance. Each lens 18 and 20 is preferably extruded from ultraviolet-stabilized polycarbonate material and therefore provides a tough, optically clear cover that protects the fragile neon tubing from vandalism, birds, and weather elements.

According to a feature of the invention, the extrusion is provided with a novel construction for use in supporting the lens 18 and 20 to facilitate ease of access to the neon tubing during maintenance or other replacement-type activities. Referring now back to FIG. 1, each support assembly preferably includes a plurality (e.g., three (3)) safety pins 22. One pin is located adjacent the end portion of each lens. Thus for example pin 22*a* is located adjacent an end 24*a* of the lens 18 and pin 22*b* is located adjacent end 24*b* of the lens 18. As shown in FIG. 1, the lens 18 and 20 are shown in a "first position" wherein the lenses are supported in a substantially end-to-end fashion. The term "substantially" is used here because in the first position the bottom end of the lens 18 and the top end of the lens 20 are slightly overlapped as shown at the reference numeral 25. Each pin 22 is located is one of the small overlapped regions.

If it is desired to access the neon tubing underlying the lens 18, the pins 22*a* and 22*b* are retracted (as will be described below). The sides of the lens 18 are then movable outward relative to the extrusion (as will be described) so that the entire lens can be moved vertically upward into the overlying support assembly 10*a*. Neither the lens nor the pins 22 can come free or fall from the support assembly. This facilitates simple access to the neon tubing for maintenance and repair.

Referring now to FIG. 2, a detailed cross-sectional view is shown of the preferred construction of the extrusion 16. Although not meant to be limiting, the present invention is adapted to be supported along a corner of a high-rise building and thus the extrusion includes an angled bottom member 30 having first and second legs 32 and 34. First and second wall members 35 and 36 extend transversely to the first and second legs 32 and 34, respectively, of the angled bottom member 30, with each of the first and second wall members 35 and 36 having a medial portion 38 and an end 40. The extrusion 16 further advantageously includes a service rail 42 extending at an obtuse angle from the end 40 of each of the first and second wall members 35 and 36, and the service rail 42 includes a tapered medial portion 44 and a retaining flange 46. The extrusion 16 also may include an inner support leg 48 extending at an obtuse angle from the medial portion 38 of each of the first and second wall members 35 and 36 to form a receiving channel 50 between each service rail 42 and each inner support leg 48 of the extrusion.

Referring now simultaneously to FIGS. 1–2, according to the invention each of the first and second lenses 18 and 20 are supported in the receiving channels 50 of the extrusion 16. As noted above, each lens has a predetermined length less than the predetermined length of the extrusion such that the second lens is movable between a first position (as shown in FIG. 1), with the first and second lenses supported in a substantially end-to-end fashion, and a second position, with the first and second lenses supported in a substantially overlapped fashion. With the lenses in the second position, access to the underlying neon tubing is freely available for maintenance purposes.

Figure 4:
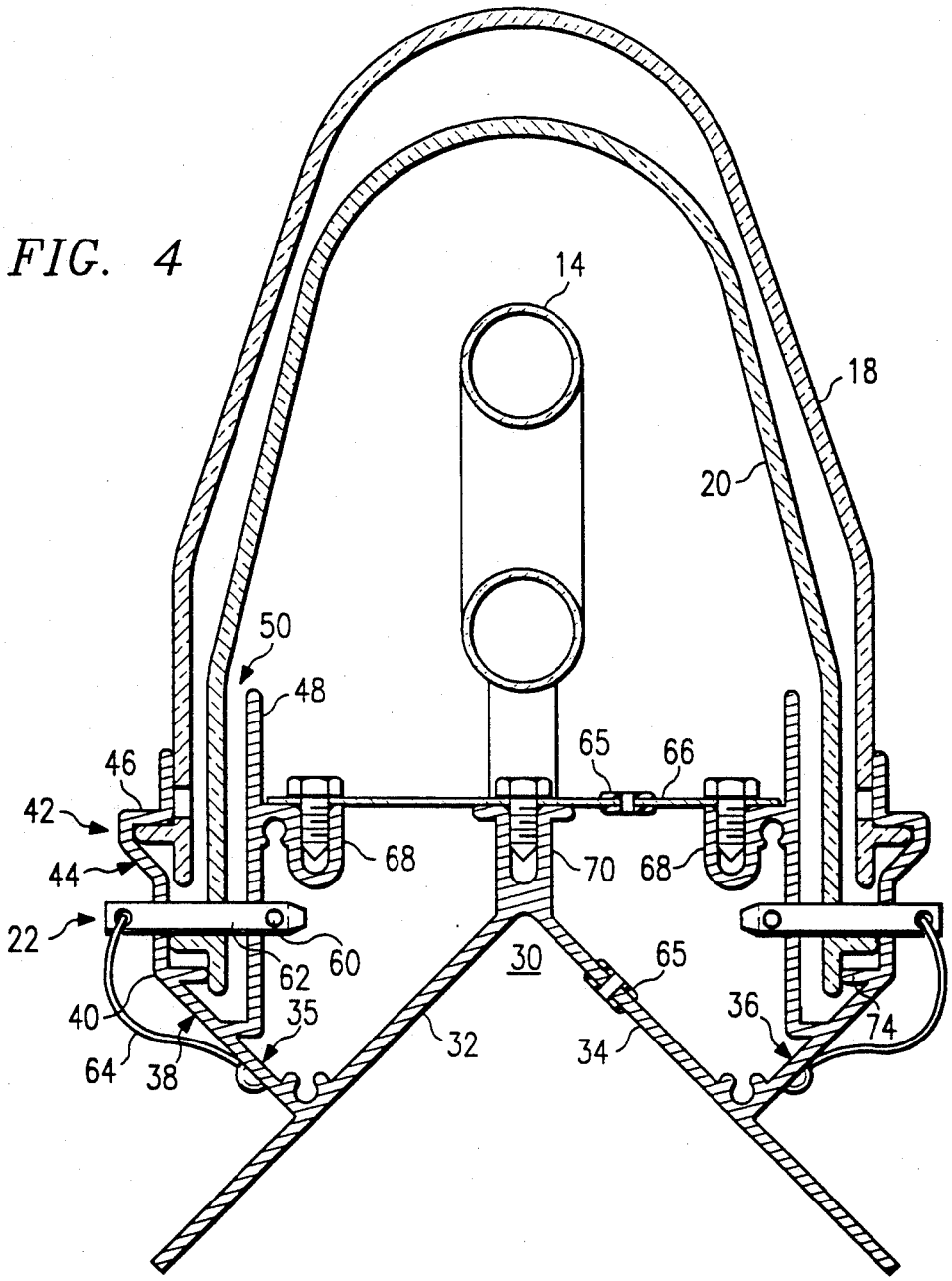
FIG. 4 is a detailed cross-sectional view of the support assembly of FIG. 3 showing the first and second lenses supported in a second or "service" position.

Referring now to FIGS. 3–4, this operation is described in detail. In particular, each lens is formed of a resilient material and includes first and second bottom edges 52 and 54 received in the receiving channels 50 of the extrusion 16. The bottom edges 52 and 54 each have an outwardly-extending member 56 that, upon removal of the pins 22, slides into the tapered medial portion 44 of the associated service rail 42 and then is retained against the retaining flange 46 thereof to enable the second lens to be moved from the first position to the second position. Thus the lens "pops" into the service rails of the extrusion when the pins are removed by virtue of the compression force retained in the resilient material. In other words, the outwardly-extending member is slid into the tapered medial portion of the service rail by a spring force provided by the resilient compressible material of the lens. Once located in the service rail, the lens is movable upwards or downwards (or sideways in a horizontal installation) depending on the pins that have been removed to facilitate access to the underlying neon tubing.

As seen in FIGS. 3–4, each pin 22 is preferably a detent pin that includes a spring-loaded ball that is pushed through holes in the approriate wall members to hold the lenses in position. For servicing, the pin is pulled out of the assembly. A tether 64 is secured to the wall 35 and is provided for retaining the pin when the lens is moved to the service position.

As also seen in FIGS. 3–4, each support assembly includes other novel features. A reflector 66 is made of aluminum and includes a facing portion preferably painted white for maximum reflection. The reflector is supported on a pair of screw supports 68 extending from each inner support leg of the extrusion, and upon a screw support 70 extending from the angled bottom member. The assembly also includes the lenses as previously described each preferably V-shaped and formed of a clear, impact-resistant plastic material such as polycarbonate or similar material. Of course, the shape of the lens member alternatively can be semi-circular, flat, oval or hexagonal without departing from the nature and scope of this invention. The extrusion also preferably includes a stop ledge 74 extending laterally inward at the intersection of each service rail and the wall member. The outwardly-extending member of the lens is retained against this ledge when the lens is in the first position.

As also seen, the extrusion 16 further includes one or more integrally-formed bosses 63, each of which are located where one of the wall members joins the angled bottom member. Each such boss preferably extends substantially the entire length of the extrusion for receiving an interconnecting pin or keeper (not shown) for interconnecting the extrusion to another similar extrusion in an end-to-end manner. Wire bushings 65 are also provided in the reflector 66 and wall 34.

To install the neon lighting system, the extrusion 16 is installed directly against or in a flush (i.e., recessed) manner at the desired site of the accent lighting. If a continuous length of tubing is required, plural extrusions are mounted in an end-to-end manner as described above. After the wiring is installed, the reflector is secured in each extrusion and the neon tubing is installed. After testing, the lenses are snapped into the extrusion to complete the installation.

Figure 5:
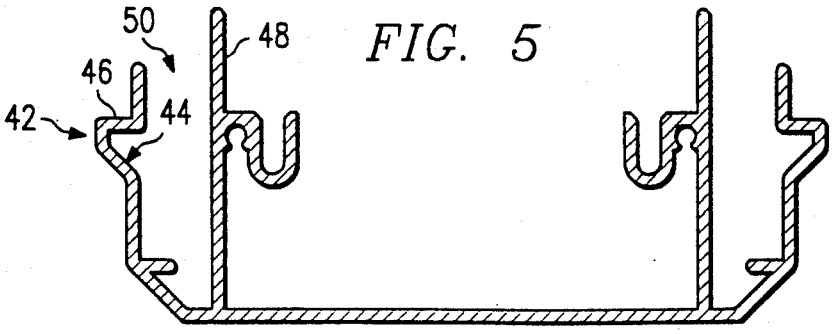
FIG. 5 is an alternate embodiment of the invention wherein the service rails are incorporated into an extrusion useful on a linear as opposed to angled extent of a building.

Referring now to FIG. 5, an alternate embodiment of the invention is shown. In this embodiment, the extrusion is useful along a linear extent of a building, whether horizontal or vertical.

It should be appreciated by those skilled in the art that the specific embodiments disclosed above may be readily utilized as a basis for modifying or designing other structures for carrying out the same purposes of the present invention. For example, the reflector can be omitted from the system or formed as part of the extrusion itself. The service rail construction can likewise be incorporated into other types of extrusions to facilitate the servicing of side-by-side sections of the neon tubing, whether such tubing is supported vertically, horizontally, along a building corner, or in any other manner. It should also be realized by those skilled in the art that such equivalent constructions do not depart from the spirit and scope of the invention as set forth in the appended claims.

What is claimed is:

1. An assembly for supporting and protecting a light tubing from environmental damage, comprising:

an extrusion having a predetermined length, the extrusion comprising:

an angled bottom member having first and second legs;

first and second wall members extending transversely to the first and second legs, respectively, of the angled bottom member, each of the first and second wall members having a medial portion and an end;

a service rail extending at an obtuse angle from the end of each of the first and second wall members, the service rail including a tapered medial portion and a retaining flange; and an inner support leg extending at an obtuse angle from the medial portion of each of the first and second wall members whereby a receiving channel is formed between each service rail and each inner support leg of the extrusion; and first and second lenses supported in the receiving channel of the extrusion, each of the first and second lenses having a predetermined length less than the predetermined length of the extrusion such that the second lens is movable between a first position, with the first and second lenses supported in a substantially end-to-end manner, and a second position, with the first and second lenses supported in a substantially overlapped manner.

2. The assembly as described in claim 1 wherein each of the first and second lenses includes first and second bottom edges received in the receiving channels.

3. The assembly as described in claim 2 wherein at least one bottom edge of the second lens has an outwardly-extending member that slides into the tapered medial portion of the service rail and then is retained against the retaining flange thereof to enable the second lens to be moved from the first position to the second position.

4. The assembly as described in claim 3 wherein the second lens is formed of a resilient compressible material.

5. The assembly as described in claim 4 wherein the outwardly-extending member is slid into the tapered medial portion of the service rail by a spring force provided by the resilient compressible material of the second lens.

6. The assembly as described in claim 1 further including a retractable fastener means for retaining each lens member in the receiving channels of the extrusion.

7. The assembly as described in claim 6 wherein the retractable fastener means includes a compression type pin, and spring means for moving the compression type pin between a first closed position and a second open position.

8. The assembly as described in claim 7 further including a tether for retaining the compression type pin when in the second open position.

9. The assembly as described in claim 1 wherein the extrusion further includes a screw support extending from each inner support leg, and a screw support extending from the angled bottom member.

10. The assembly as described in claim 9 further including a reflector retained on the screw supports.

* * * * *